US006899590B2

(12) United States Patent
Luk

(10) Patent No.: US 6,899,590 B2
(45) Date of Patent: May 31, 2005

(54) BRASSIERE CUP WITH RHINESTONES DETAILING AND RELATED METHOD OF MANUFACTURE

(75) Inventor: Theone Luk, Kwai Chung (HK)

(73) Assignee: Regina Miracle International Limited (HK)

( * ) Notice: Subject to any disclaimer, the term of this patent is extended or adjusted under 35 U.S.C. 154(b) by 164 days.

(21) Appl. No.: 10/348,655

(22) Filed: Jan. 21, 2003

(65) Prior Publication Data

US 2004/0229543 A1 Nov. 18, 2004

(51) Int. Cl.[7] ..... A41C 3/00

(52) U.S. Cl. ..... 450/57; 450/39; 450/1; 2/244; 2/246; 2/267

(58) Field of Search ..... 450/53–57, 1; 2/267, 244, 246, 268; 156/245; 264/257, 258, 291, 292, 294, 320, 321, 145, 148, 152–155, 157, 160, 163

(56) References Cited

U.S. PATENT DOCUMENTS 3,795,921 A * 3/1974 Zucker ..... 623/7
3,830,224 A * 8/1974 Vanzetti et al. ..... 600/549
5,167,743 A 12/1992 Chalfin ..... 156/230
5,899,790 A * 5/1999 Berg ..... 450/1
6,231,423 B1 * 5/2001 Deal et al. ..... 450/57
6,332,862 B1 * 12/2001 Zandman ..... 600/15
6,364,741 B1 * 4/2002 Ferguson ..... 450/57
6,482,285 B2 11/2002 Cross ..... 156/230

OTHER PUBLICATIONS

InStyle Magazine "L'il Kim in Versace", p. 61; "Best Bras–go a little crazy– Victoria's Secret Millenium Gem Bra", p. 120. ; Feb. 2000.*

* cited by examiner

*Primary Examiner*—Gloria M. Hale
(74) *Attorney, Agent, or Firm*—Ostrolenk, Faber, Gerb & Soffen, LLP

(57) ABSTRACT

A method of manufacturing a breast cup for a brassiere by taking a sheet of moldable material and adhering a plurality of pellets against a major surface of the sheet of moldable material. A molding to a breast cup form of the sheet of moldable material occurs prior, during or subsequent to the application of pellets in a manner such that the pellets are or becomes located in a desired location on the convex side major surface of the then molded sheet of molded material.

8 Claims, 4 Drawing Sheets

BRASSIERE CUP WITH RHINESTONES DETAILING AND RELATED METHOD OF MANUFACTURE

FIELD OF THE INVENTION

The present invention relates to a brassier or brassiere cup which incorporates rhinestones detailing to enhance the visual appearance of the exterior of the cup.

BACKGROUND

Decorative aspects of a brassiere (bra) are important to women. Whilst bras have traditionally been used purely as undergarments, some people prefer that any parts of a bra visible to another person appear attractive in nature. In addition, whilst some parts of a bra may not be visible, a person may place some emphasis on the bra's visual appeal during a purchasing decision.

It is common to incorporate lace to provide a visually appealing effect to a bra. However, lace may need to be sewn onto a cup or alternatively be embroidered therewith.

With the advent of bras made by molding, reduced cost of manufacturing is the object of the manufacturing of such bras. Molded bras may be manufactured from one or multiple overlying plies of moldable material. The addition of embroidery may be time consuming. Likewise, the stitching of lace onto a cup of a molded bra may add to the cost of the bra. It has hence been desirable to manufacture a bra which includes visually enhancing features that can be provided at a reduced cost.

Accordingly it is an object of the present invention to provide a bra or bra cup which incorporates rhinestones detailing and a related method of manufacturing such a bra or cup which may at least provide the public with a useful choice.

BRIEF DESCRIPTIONS OF THE INVENTION

In accordance with an example embodiment of the present invention, a method of manufacturing a breast cup for a brassiere is provided. The method comprises:

a. taking a sheet of moldable material b. adhering to part of one of the major surfaces of said sheet of moldable material an adhesive film which carries therewith a plurality of pellets adhered to said adhesive film in a predefined pattern in a manner such that said pellets are placed against said major surface of said sheet of moldable material, c. pressing said pellets against said sheet of moldable material to adhere said pellets to that major surface of said sheet of moldable material in said predefined pattern d. removing said adhesive film from said sheet of moldable material leaving said pellets affixed to said major surface wherein a molding to a breast cup form of said sheet of moldable material occurs prior to step (b) or subsequent to step (d) in a manner such that said predefined pattern of pellets is or becomes located in a desired location on the convex side major surface of said then molded sheet of molded material.

Preferably, heat is also applied during the pressing of pellets to said sheet of moldable material, so that said pellets become heat welded to said sheet of moldable material.

Preferably, two heated pressure plates apply the heat and pressure, with at least the region of the sheet of moldable material where said pellets are positioned being interposed between the heated pressure plates.

Preferably, two heated pressure plates apply the heat and pressure, and the entire sheet of moldable material is interposed between these pressure plates.

Preferably, a jig indicates the location on the major surface where the adhesive film is to be positioned for adhering thereof to the major surface.

Preferably, the pellets are dome shaped and are carried by the adhesive film such that the apex of each dome shaped pellet is located against the adhesive film, and the base of the dome shaped pellet is located against the major surface of the moldable material.

Preferably, after the molded material has been formed into a cup, excess material is trimmed o define a breast cup.

In accordance with another example embodiment of the present invention, another method of manufacturing a breast cup for a brassiere is provided. The method comprises:

a. taking a sheet of moldable material b. adhering a plurality of pellets against a major surface of said sheet of moldable material wherein a molding to a breast cup form of said sheet of moldable material occurs prior, during or subsequent to step (b) in a manner such that said pellets are or becomes located in a desired location on the convex side major surface of said then molded sheet of molded material.

Preferably, the pellets are adhered to the major surface of the sheet said by heat welding.

In accordance with another example embodiment of the present invention, a breast cup for a brassiere is provided. The breast cup comprises a molded material incorporating, at a region of the convex side surface thereof, a plurality of pellets permanently adhered to the convex die surface.

Preferably, the pellets are adhered to the surface by heat welding.

Preferably, the pellets are rhinestones.

Preferably, the pellets are positioned on the surface to define a pattern or discernable shape.

Preferably, the pellets are provided at an upper region of the breast cup.

In a further aspect the present invention consists in a breast cup which is made according to the method as herein before described.

In accordance with another example embodiment of the present invention, a brassiere is provided. The brassiere incorporates two breast cups made according to the method described above.

The various example embodiments described herein include the parts, elements and features referred to or indicated in the specification of the application, individually or collectively, and any or all combinations of any two or more of said parts, elements or features.

Where specific integers are mentioned herein which have known equivalents in the art to which this invention relates, such known equivalents are deemed to be incorporated herein as if individually set forth. For the purposes of illustrating the invention, there is shown in the drawings a form which is presently preferred. It should be understood, however, that the example embodiments of the present invention described herein are not limited to the precise arrangements shown.

DETAILED DESCRIPTION OF THE INVENTION

Figure 1:
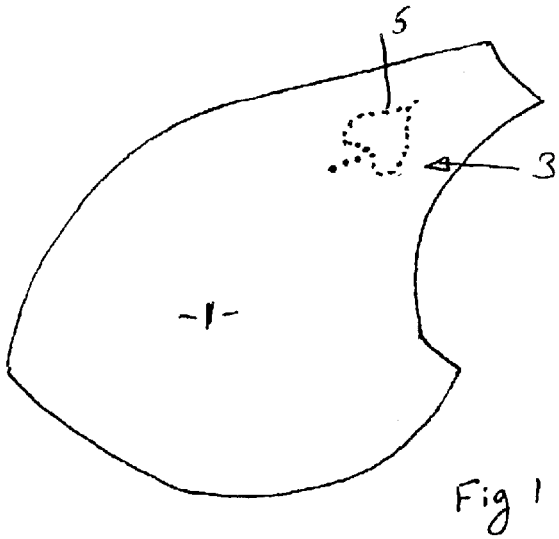
FIG. 1 illustrates a plan view of a breast cup which incorporates rhinestone detailing.

With reference to FIG. 1, there is shown a breast cup 1 to be incorporated with other components to define a brassiere (bra). The breast cup 1 is of a molded kind and is preferably made from suitable material, which is assembled or defined to have no seams. The material from which the breast cup 1 is molded may consist of a single ply of material or may alternatively consist of a multi-ply assembly. A sheet of material from which the breast cup 1 is defined is preferably a moldable material in the form of a planar sheet. Where the sheet of moldable material is used to form a multi-ply assembly, preprocessing may be performed to define the assembly. This preprocessing may include laminating the plies together using heat lamination and/or adhesive lamination. A multi-ply assembly may, for example, consist of a foam core interposed between two exterior plies of a fabric material.

The material used for a multi-ply assembly or for a single ply sheet is selected such that, when subjected to heat and pressure, a cup shape can be molded into the sheet and be retained by the sheet.

Figure 2:
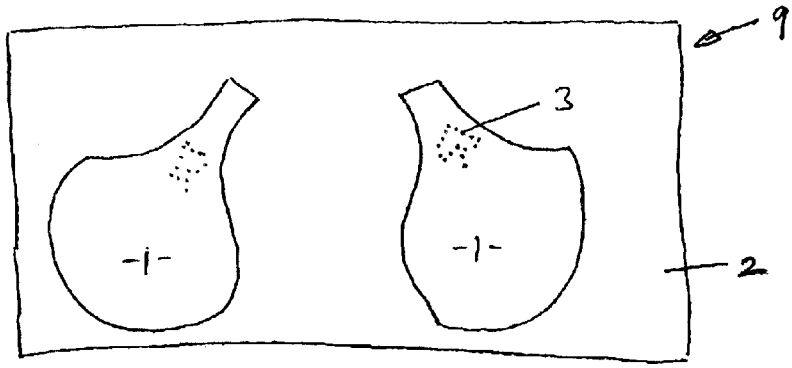
FIG. 2 illustrates two mirror image breast cups having been formed from a sheet of moldable material and wherein the rhinestone detailing is provided.

By way of example, FIG. 2 illustrates a sheet of such moldable material 9, into which two breast cups 1 have been molded by male and female molding portions of a molding device (not shown). The molding device applies pressure to the sheet of moldable material 9 and, with the appropriate molding relief features, creates three dimensional cup features in the sheet of moldable material 9 of appropriate size.

In the most preferred form, before the cups 1 are molded into the moldable material 9, pellets 5 are applied to one of the major surfaces 2 of the sheet of moldable material 9. Such pellets 5, once the process has been completed, define a detailing region 3 on the convex side major surface 2 of the cups 1. In an alternative but less preferred embodiment, the pellets 5 are applied to the cups 1 after the cups 1 have been formed.

A plurality of pellets 5 are utilized to form a predefined pattern according to a detailing region 3 that is desired on the surface of the breast cups 1.

The most preferred method in which the pellets 5 are transferred to the sheet of moldable material 9 will now be described.

Figure 3:
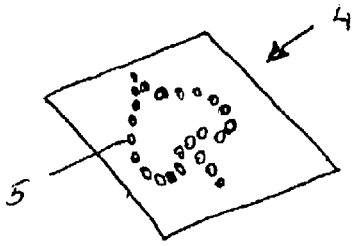
FIG. 3 illustrates a transfer sheet of film material onto which the pellets for the rhinestone detailing are provided.

Each pellet 5, which forms part of the detailing region 3, is engaged to a transfer assembly 4. The pellets 5 are placed onto a first film 6 of the transfer assembly 4 in appropriate locations to define the desired pattern, as shown, for example, in FIG. 3. The first film 6 of the transfer assembly 4 is an adhesive film 6, and pellets 5 adhere to the surface 7 of the first film 6 of the transfer assembly 4.

In the most preferred embodiment, a second film 8 is provided as part of the transfer assembly 4. The second film 8 overlies the first film 6 on the side 7 of the first film 6 so that the pellets 5 are interposed between the first and second films 6, 8. The adhesive nature between the films 6 and 8 is such that the film 8 can be peeled away from the film 6 and from the pellets 5. The film 8 provides a cover or backing sheet to the adhesive side 7 of the film 6 and overlies the pellets 5 so that the transfer assembly 4 can be conveniently handled. Without the provision of the second film 8, the pellets 5 may dislodge and/or the adhesive nature of the first film 6 may be adversely effected by dust or the like.

Figure 5:
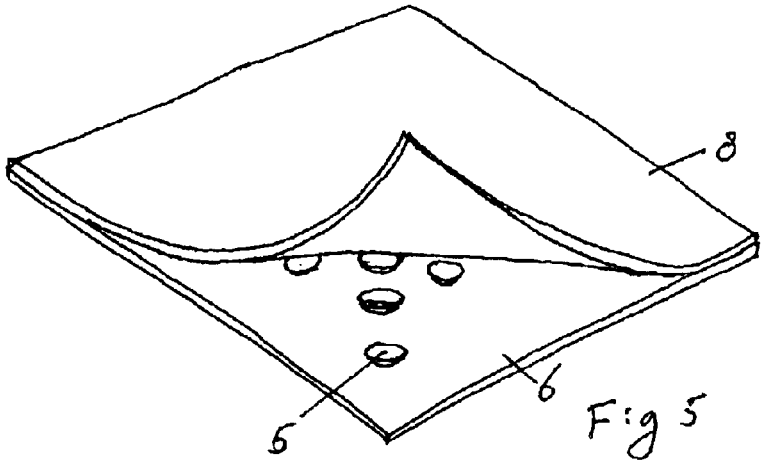
FIG. 5 is a perspective view of the transfer sheet and wherein one of the layers of film material is partially peeled away for the purposes of allowing the transferring of pellets to the sheet of moldable material.
Figure 6:
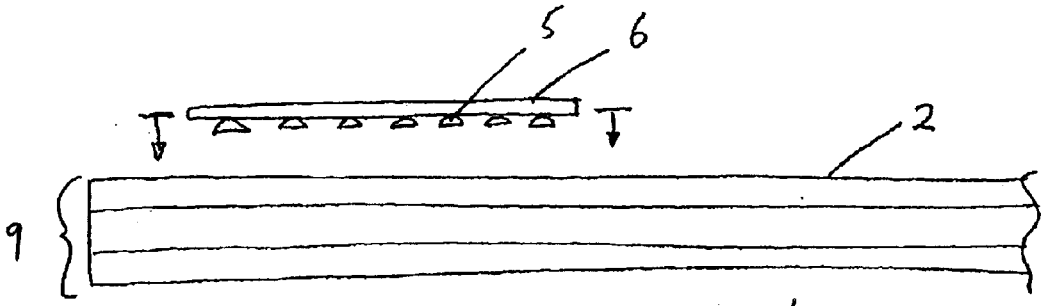
FIG. 6 is a side view of a sheet of moldable material and illustrating the positioning of a transfer sheet prior to being engaged to the sheet of moldable material.
Figure 7:
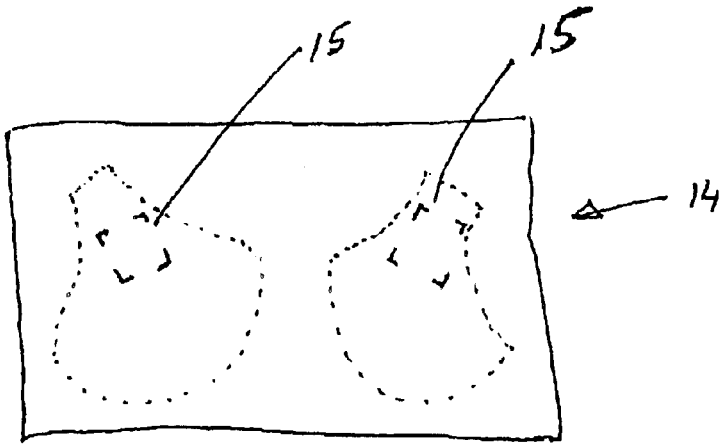
FIG. 7 is a plan view of a jig which can be utilized for assisting the placement of the transfer sheet retaining the pellets in order to ensure that the transfer sheet(s) is positioned in the appropriate location on the moldable sheet of material.

The transfer assembly 4 positions the pellets 5 onto the major surface 2 of the sheet of moldable material 9 by first having the second film 8 peeled away therefrom. With reference to FIG. 5, it can be seen that the second film 8 is partially peeled away from the first film 6, thereby exposing the pellets 5. The sheet of moldable material 9 is then able to receive the pellets 5 onto its first major surface 2. The pellets 5, since they remain retained to the first film 6, are maintained in their originally defined locations, thereby allowing the pattern of pellets 5 to be transferred to the major surface 2 of the sheet of moldable material 9.

The adhesive characteristics of the first film 6 of the transfer assembly 4 also ensures that the first film 6 is adhered to the first major surface 2 of the sheet of moldable material 9.

Figure 8:
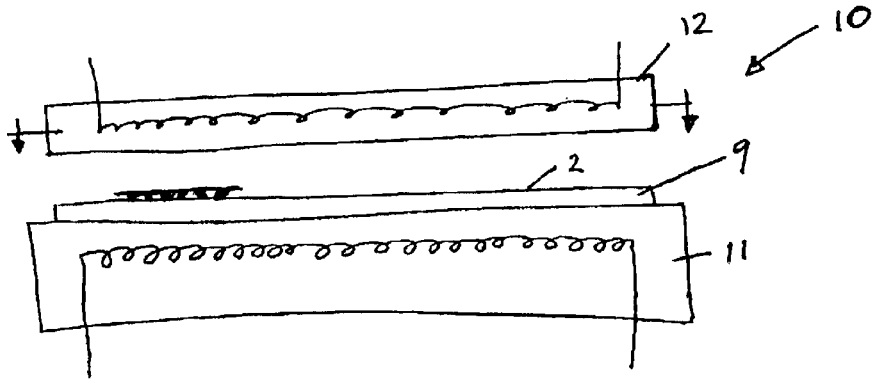
FIG. 8 is a sectional view through a device for the purposes of welding the pellets to the sheet of moldable material.
Figure 9:
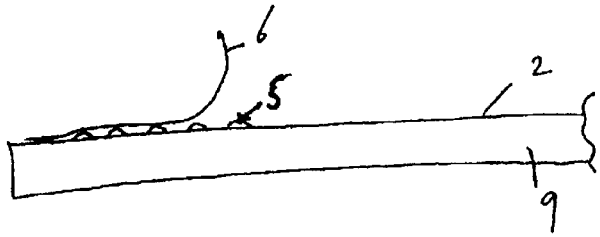
FIG. 9 illustrates the pellets engaged to the sheet of moldable material and wherein the film of the transfer sheet is peeled away to leave only the pellets which have been transferred against the sheet of moldable material.

The sheet of moldable material 9, with the transfer assembly 4 engaged thereto, can then be transferred to a pellet welding device 10. The pellet welding device 10 preferably consists of two pressure plates 11, 12. The pressure plates 11, 12 are sized to provide pressure to at least the region of the sheet of moldable material 9 where the pellets 5 are provided. As shown, for example, in FIG. 8, the pressure plates 11, 12 are sized to be at least coextensive and preferably larger than the overall size of the sheet of moldable material 9. In this manner, the entire sheet of moldable material 9 is subjected to substantially the same pressure and temperature while the pellets 5 are welded to the first major surface 2 of the sheet of moldable material 9. This procedure is more preferred because it creates a uniform change of characteristics of the entire sheet of moldable material 9, so that, when the sheet of moldable material 9 is molded to define the cups 1, the cups 1 are uniform.

During the transfer step, the welding device 10 applies a pressure to the sheet of moldable material 9. The sheet of moldable material 9 is placed between the first and second pressure plates 11, 12 in a substantially planar condition, and the plates 11, 12 are then brought together. With an appropriate pressure and dwell time and by heating the first and second pressure plates 11, 12, the pellets 5 weld and adhere to the first major surface 2 of the sheet of moldable material 9.

After the pellets 5 are transferred and welded to the first major surface 2 of the sheet of moldable material 9, the first film 6 can be peeled away, thereby leaving the pellets 5 in an exposed condition at the first major surface 2 of the sheet of moldable material 9.

As an example, the sheet of moldable material 9 may consist of a core layer of urethane foam of a thickness of approximately 1 mm to 5 mm. The plies of material which are provided to define the first and second major surfaces of the sheet of moldable material 9 may be a fabric material, such as polyester based cotton, LYCRA, spandex or nylon. Where the material is a polyester based cotton, the transfer step preferably applies a pressure to the sheet of moldable material 9 at a temperature of approximately 130° C. and for a period of approximately 30 seconds. This procedure is sufficient to ensure that the pellets 5 weld to the first major surface 2 of the sheet of moldable material 9. This procedure also ensures that the pellets 5 do not become over welded to the sheet of moldable material 9, which may affect the visual appearance of the pellets 5.

After transferring the pellets 5 to the sheet of moldable material 9, the sheet of moldable material 9 is transferred to a molding machine to mold the cups 1 therein.

If the detailing region 3 is provided in repeatable locations so that a plurality of bras can be manufactured having identical appearances, a register step is employed.

During the breast cup molding stage, the sheet of moldable material 9 is be placed into a molding machine that applies molding pressure via two mold portions having appropriately defined surface reliefs, so that the three dimensional cups 1 can be molded. Pressure, temperature, and the appropriate dwell time ensure that, when the two mold portions are released, the three dimensional cups 1 are maintained. The sheet of moldable material 9 is placed to align with the molding device in an appropriate location. To ensure that the detailing region 3 provided on a major surface of the then flat sheet of moldable foam material 9 is positioned in an appropriate and desirable location (such that when a molding of the sheet material occurs), a jig 14 may be utilized.

The jig 14 preferably consists of a sheet of rigid or semi rigid material. The jig 14 can be placed onto the sheet of moldable material 9 so that moldable material 9 registers (i.e., aligns) therewith. The sheet of moldable material 9 may include register points corresponding to register points of the jig 14. The register points of the sheet of moldable material 9 are aligned with the register points of the jig 14. Alignment of the moldable material 9 with the jig 14 may be achieved, for example, by providing jig 14 with a perimeter that is identical to the perimeter of the sheet of moldable material 9. The jig 14 can then be placed onto the sheet of moldable material 9 in a coextensive manner. The jig 14 incorporates further register points 15 which define where each transfer assembly 4 is be placed. The further register points 15 may, for example, comprise apertures through the jig 14. These apertures allow the transfer assembly 4 to be placed therethrough and straight onto the major surface 2 of the sheet of moldable material 9. Alternatively, the first film 6 of the transfer assembly 4 may be tacked to a surface of the jig 14 at locations defined by the further register points 15 and then positioned against the major surface 2 of the sheet of moldable material 9. The first film 6 may thereafter be released from the jig 14, once the film 6 becomes adhered to the first major surface 2 of the sheet of moldable material 9. The transfer assembly 4 containing the pellets 5 is then placed in the appropriate locations on the sheet of moldable material 9. As a result, the pellets 5 are positioned in appropriate locations of the sheet of moldable material 9 when the breast cups 1 are molded.

In a less preferred embodiment, the cups 1 are produced before the pellets 5 are transferred thereto. Such subsequent transfer may utilize the same mold used for molding the cups 1, as well as the transfer assembly 4 used for holding the pellets 5 in appropriate locations on the sheet of moldable material 9. As the transfer assembly 4 is most conveniently produced in a planar form, the transfer assembly 4 is more difficult to control during the transferring step once placed on the curved bra. This is why this embodiment is less preferred.

The second film or backing sheet 8 of the transfer assembly 4 is preferably a white or light color backing sheet, and the first film or transfer film 6 of the transfer assembly 4 is preferably transparent. The use of a transparent film for the first or transfer film 6 ensures that the transfer assembly 4 on the sheet of moldable material 9 may be visually inspected before the pellets 5 are welded to the first major surface 2 of the sheet of moldable material 9. This allows an operator to observe whether any of the pellets 5 are missing and to reject any non-compliant transfer assembly 4.

Figure 4:
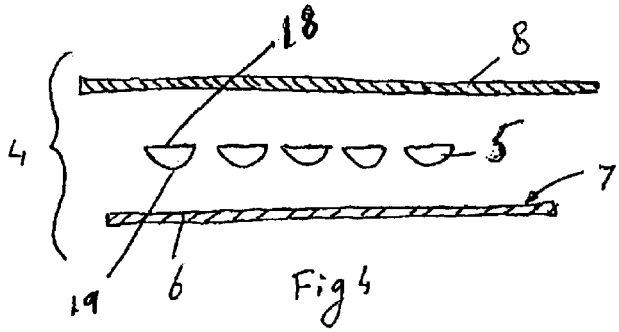
FIG. 4 is a sectional view through part of the transfer sheet of FIG. 3 and shown in an exploded format to illustrate the nature of the transfer sheet assembly.

As can be seen with reference to FIG. 4, the pellets 5 are preferably dome-shaped. The bases 18 of the dome-shaped pellets 5 are preferably substantially planar, and the bases 18 adhere to the first major surface 2 of the sheet of moldable material 9. Apex regions 19 of the dome-shaped pellets 5 adhere to the transfer film 6 of the transfer assembly 4. The pellets 5 are preferably at least partly made of plastic. The bases 18 of the pellets 5 are also made of plastic so that the bases 18 may plastically weld to the plastic material of the first major surface 2 of the sheet of moldable material 9.

It will be appreciated that alternative shapes for the pellets 5 can be utilized to achieve the same effect.

It should also be appreciated that, although the various embodiments described herein attach the pellets 5 to the moldable material 9 by the preferred method of welding, alternative methods of attachment may be utilized, such as attachment by adhesive to achieve adequate adhesion of the pellets 5 to the cup forms 1. To attach the pellets 5 to the cup forms 1, the bases 18 of the pellets 5 may be dipped, for example, into an adhesive prior to being transferred to the cup forms 1. Heat welding has, however, been found by the inventor to be the most convenient method.

The first major surface 2 of the sheet of moldable material 9 is the convex surface of the breast cups 1. The detail region 3 is preferably provided towards the upper region of the breast cups 1 so that the detail region 3 is visible, or at times is visible, while the bra incorporating the breast cups 1 of the present invention is worn.

Figure 10:
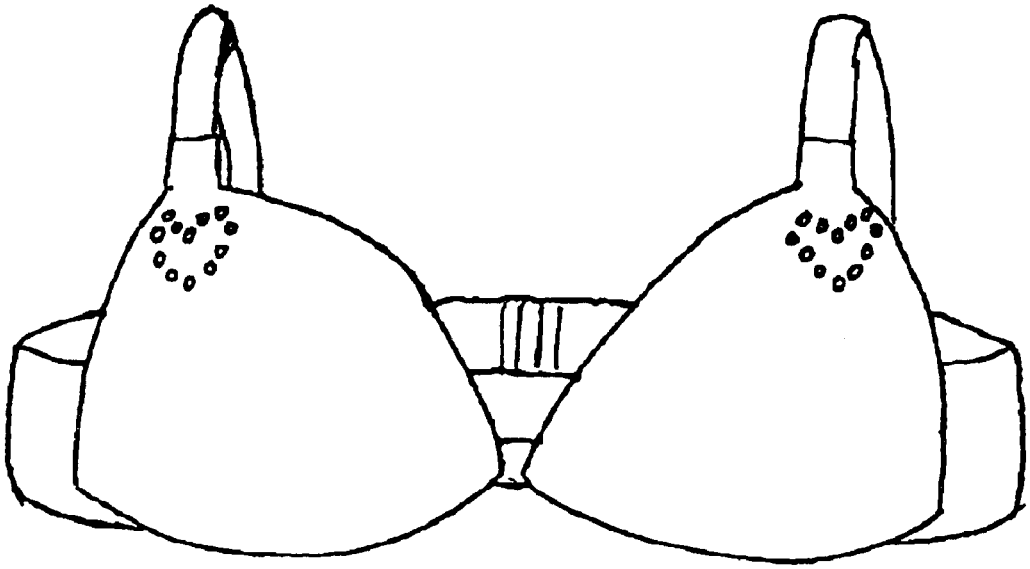
FIG. 10 illustrates a finished bra.

FIG. 10 illustrates a finished brassiere 101 containing a detail region 3 on each cup 1.

Hot fix transfer techniques known to persons skilled in the art can be utilized to apply the pellets 5. Conventional hot fix transfer technology, for example, utilizes an iron to transfer the pellets 5 onto a material. Heat sensitive glue can be utilized. This glue, when heated, melts and adheres to both the pellets 5 and the fabric. Such glue dries to a flexible state so that the garment to which the pellets 5 are adhered can be washed without the pellets 5 falling off.

Reference is hereby made to the patent specification under U.S. Pat. No. 5,167,743 which discloses a method of manufacturing a transfer assembly, such method being an option which can be employed for the provision of the transfer assembly of the present invention. The entire content of the patent specification of U.S. Pat. No. 5,167,743 is by way of reference hereby incorporated.

Reference is also made to the patent specification of U.S. Pat. No. 6,482,285 which describes details of material selection for creating a transfer which takes into consideration the material stability under heat and pressure and which still provides a sufficiently useful release characteristic to allow for the supporting film to be peeled away from the fabric material. Alternative material selections will inevitably also be obvious to a person skilled within the art. The content of the specification of U.S. Pat. No. 6,482,285 is by way of reference hereby incorporated.

The present invention may be embodied in other specific forms without departing from the spirit or essential attributes thereof and accordingly reference should be made to the appended claims rather than the foregoing specification as indicating the scope of the invention.

What is claimed is:

1. A method of manufacturing a breast cup for a brassiere comprising:

adhering a plurality of pellets to an adhesive film;

adhering the pellets with the adhesive film adhered thereto to a region of a major surface of a sheet of moldable material to form a pattern of the pellets;

pressing the pellets against the sheet of moldable material to facilitate the adhesion of the pellets to the major surface of the sheet of moldable material;

removing the adhesive film from the sheet of moldable material, such that the pellets remain adhered to the major surface of the sheet of moldable material after the adhesive film is removed; and molding the sheet of moldable material into a breast cup, such that the pattern of the pellets is located in a desired location on the major surface of the sheet of moldable material, the molding of the sheet being performed before the pellets are adhered to the sheet of moldable material or after the adhesive film is removed from the sheet of moldable material.

2. A method as claimed in claim 1, wherein the pellets comprise rhinestones.

3. A method as claimed in claim 1 further comprising applying at least one of heat and pressure to the pellets while the pellets are pressed against the sheet of moldable material to heat weld the pellets to the sheet of moldable material.

4. A method as claimed in claim 3 wherein the at least one of heat and pressure is applied by two heated pressure plates between which is positioned the region of the sheet of moldable material to which the pellets are adhered.

5. A method as claimed in claim 4 wherein the entire sheet of moldable material is positioned between the pressure plates while the at least one of heat and pressure is applied to the pellets.

6. A method as claimed in claim 1 further comprising aligning the adhesive film to the region of the sheet of moldable material using a jig before the pellets are adhered to the region of the sheet of moldable material.

7. A method as claimed in claim 1 wherein each of the pellets is dome shaped having an apex and a base, the apexes of the pellets are adhered to the adhesive film, and the bases of the pellets are adhered to the region of the sheet of moldable material.

8. A method as claimed in claim 1 further comprising trimming excess material of the sheet of moldable material after the sheet of moldable material is molded into the breast cup.

* * * * *